US007830248B2

(12) United States Patent
Logvinov et al.

(10) Patent No.: US 7,830,248 B2
(45) Date of Patent: Nov. 9, 2010

(54) NETWORKING AND MULTIMEDIA ADAPTER FOR POWER OUTLETS

(75) Inventors: Oleg Logvinov, East Brunswick, NJ (US); Brion Ebert, Easton, PA (US)

(73) Assignee: Arkados, Inc., Piscataway, NJ (US)

( * ) Notice: Subject to any disclaimer, the term of this patent is extended or adjusted under 35 U.S.C. 154(b) by 947 days.

(21) Appl. No.: 11/511,666

(22) Filed: Aug. 28, 2006

(65) Prior Publication Data

US 2007/0047573 A1 Mar. 1, 2007

Related U.S. Application Data

(60) Provisional application No. 60/712,074, filed on Aug. 29, 2005.

(51) Int. Cl.
*G08B 1/08* (2006.01)

(52) U.S. Cl. ..... 340/538; 340/693.1; 340/310.11

(58) Field of Classification Search ..... 340/815.45, 340/815.4, 538.17, 538, 539.12, 693.1, 310.11, 340/310.15, 310.16, 538.15, 825.24; 439/488, 439/911; 381/58, 59; 361/797
See application file for complete search history.

(56) References Cited

U.S. PATENT DOCUMENTS

| | | | | |
|---|---|---|---|---|
| 4,924,349 | A | 5/1990 | Buehler et al. | 361/357 |
| 5,805,053 | A | 9/1998 | Patel et al. | 340/310.01 |
| 6,810,204 | B2 | 10/2004 | Grone et al. | 392/392 |
| 6,842,459 | B1 | 1/2005 | Binder | 370/463 |
| 6,924,744 | B2 * | 8/2005 | Bohlander et al. | 340/815.45 |
| 6,927,340 | B1 | 8/2005 | Binder et al. | 174/66 |
| 6,934,862 | B2 * | 8/2005 | Sharood et al. | 713/300 |
| 7,118,407 | B2 * | 10/2006 | Ching | 439/488 |
| 2005/0069305 | A1 | 3/2005 | He et al. | 392/392 |

* cited by examiner

*Primary Examiner*—Anh V La

(57) ABSTRACT

A power outlet adaptor device having a housing, at least one multimedia, networking and/or communications component, and an electrical socket box including at least one electrical socket is provided. The multimedia, networking, and/or communications component is secured within the housing and provides multimedia, networking and/or communications capabilities. The electrical socket accommodates an electrical device plug. The housing fits around the electrical socket box. The electrical socket box electrically couples to the multimedia, networking, and/or communications component.

24 Claims, 8 Drawing Sheets

NETWORKING AND MULTIMEDIA ADAPTER FOR POWER OUTLETS

CROSS-REFERENCE TO RELATED APPLICATIONS

This Application claims priority to the U.S. Provisional Patent Application No. 60/712,074, filed Aug. 29, 2005, and incorporates its subject matter herein by reference in its entirety.

This Application relates to commonly-owned and currently abandoned U.S. patent application Ser. No. 10/211,033 to Manis et al., filed Aug. 2, 2002 and titled "Network-to-network adaptor for power line communications", and incorporates its subject matter herein by reference in its entirety. This Application also relates to commonly-owned and currently pending U.S. patent application Ser. No. 11/281,072 to Logvinov et al., filed Nov. 17, 2005 and titled "Powerline communication PHY with a digital direct drive output stage", and incorporates its subject matter herein by reference in its entirety. This Application also relates to commonly-owned and currently pending U.S. patent application Ser. No. 10/211,759 to Manis et al., filed Aug. 2, 2002 and titled "Power line communication system", and incorporates its subject matter herein by reference in its entirety. This Application also relates to commonly-owned and currently abandoned U.S. patent application Ser. No. 10/219,520 to Manis et al., filed Aug. 15, 2002 and titled "Coupling between power line and customer in power line communication system", and incorporates its subject matter herein by reference in its entirety. This Application also relates to commonly-owned and currently abandoned U.S. patent application Ser. No. 10/423,787 to Logvinov et al., filed Apr. 25, 2003 and titled "Powerline communications system for providing multiple services to isolated power generating plants", and incorporates its subject matter herein by reference in its entirety.

BACKGROUND OF THE INVENTION

1. Field of the Invention

The present invention relates to power line communications. Specifically, the present invention relates to adaptor devices configured to be attached to existing wall outlets, where the adaptor devices incorporate networking, power, and multimedia circuitry for communicating with various devices, systems, and networks.

2. Background of the Invention

There exist today many forms and types of networks, both wired and wireless, that allow for high speed data communication. The common thrust of all of these networks is to provide communication between devices, as well as access to the Internet. On the other hand, the common problem with many of these networks is that they have to be deployed, which can be very costly and time consuming just to set up the network infrastructure. In recent years there has been substantial interest in coming up with a way of communicating at high speeds and at high data rates over AC power lines. Power lines are advantageous because the network is already in place and is available to almost every home and business in the world.

Power lines and power transmission networks suffer from some problems, most notably noise and inconsistent impedance. Power line communication is not a new concept, and there have been various methods and technologies that have been developed to allow for reliable communication. One such method that can be used for broadband communication is OFDM (Orthogonal Frequency Division Multiplexing).

This allows for the use of a large number of closely spaced carriers to transmit data across the line. This carrier multiplexing along with the use of data interleaving and FEC coding provide a robust and reliable communication method to overcome the inherent problems of a power line.

When looking at a common power transmission network, it can be broken up into three (3) main segments. From a standard power substation, there is commonly a "distribution" network of medium voltage power lines, configured in a loop and several miles in length, that feed out to an area of homes and businesses. Then, at various points on the loop there exist step down transformers that provide a series of 110-240 V "access" lines depending on the country to a small number of homes and/or businesses. At the end of each one of these lines there is typically a meter or meters present for each electricity customer served by that line. Then, on the other side of each meter there exists a typical "in-home" electricity distribution network inside a home or business.

It can be seen that all three of the network segments could possibly be used to transmit data across. However, it can be said that the "access" and "in-home" segments of this network are adjacent networks, with only an electricity meter in between. Also, it is very likely that the data transmitted on each of these segments will be for different purposes and have different destinations. For example, data transmitted on the access network segment could have multiple destinations or could be available to all end points, whereas data on an in-home network would likely be internal to that home or business. Thus, it is advantageous to logically separate these network segments to allow for separation and protection of data traveling on each segment. One possible method of accomplishing this is to allocate different frequency ranges or time segments for each segment. This allows for separation and also non-interference between segments.

A problem may arise, however, in this arena where there exists a legacy system in place, operating in a certain frequency range or within a predetermined time structure, and there is a desire to add communication on another network segment. In this case the legacy system may have to disable some of its carriers or reallocate time segments to allow for bandwidth allocated to the new system, thus diminishing its own bandwidth. However, the legacy system may not allow for this. It is also conceivable that the legacy system could be shifted up or shifted down in frequency or forced to change the behavior with regard to the timing of the communication to accommodate, but this would most likely require a change to the hardware and also would no longer allow it to communicate with other units of the same type. There is also the possibility of using blocking filters to isolate the network segments, but this would add extra expense and installation cost and may not be advantageous for many applications.

There exist today a number of communication networks that operate over a broad band and at high speeds. These networks may operate on different mediums and different frequency ranges, but they all must comply with a certain radiation limit as well as other limits that may be imposed based on other devices or networks operating in the same frequency range. Due to the broadband nature of these networks, it is likely that there will be areas of the frequency band that cannot be used due to other communication devices occupying these areas. A common example of this would be amateur radio bands that occupy certain frequencies throughout the RF radio spectrum. This may require notches to be put in place throughout a broadband communication system's operating frequency range. Another common requirement at the edges of this range is to have a steep roll off in transmitted power and be able to comply with a certain power spectral density limit beyond the edges of the operating frequency range. This often contributes to additional high-order filters or other means of spectral management being added to the design.

These high-order filter requirements can make the design of an analog front end very complicated, very large, and therefore very costly. In order to keep these issues in check, and to still satisfy the filtering requirements, it may be advantageous to increase the sampling frequency of the analog front end. This will often allow for simplifying of the filter designs as well as improved resolution on the received signal.

Power line communication (PLC) systems are well known in the art. See, for example, the book entitled "The Essential Guide to Home Networking Technologies" published in 2001 by Prentice-Hall, Inc., co-pending U.S. application Ser. No. 09/290,255, filed Apr. 12, 1999, the web site http://www.homeplug.org of the Home Plug Powerline Alliance and the article entitled "Home Plug Standard Brings Networking to the Home" in the December 2000 issue, Vol. 16, No. 12, of the Communication Systems Design magazine.

Power line communications for Internet access is a powerful technology that offers the consumer many real advantages over other forms (e.g., DSL, cable modems, etc.). These advantages include: power distribution networks to all homes and businesses are already in place, and PLC technology has been demonstrated to work at high data rates, as well as many other advantages. Power line communications allow making communication connections in a low cost manner between the power line distribution cables or wires, such as the pole-mounted cables or wires (any segment of the power line distribution network applies here including, but not limited to the LV (low voltage) and MV (medium voltage) networks and the home or business offices. Connecting to the power distribution network can be difficult and expensive requiring turning off network power during installation.

Power line communication systems apply modulated radio frequency carriers, e.g. carriers having frequencies in the range from about 2-80 MHz for access and from about 2 MHz to 50 MHz, for in home communications to power lines.

Electrical power distribution systems, commonly used in the United States, distribute the electrical power at 60 Hz from the source over cables, insulated or uninsulated. At the source, the voltage is high, e.g., over 200,000 volts and by means of transformers, the voltage is reduced by a transformer or transformers to a medium voltage, e.g., of the order of 20,000 volts, to be delivered to consumers by at least three cables or wires suspended from poles. At some of the poles, there are transformers which further reduce the voltage to low voltage of the order of 117 volts between a cable and a ground or neutral cable for the delivery of power to one or more customers or consumers. The power lines from the output of a pole transformer to the customers premises connect to a power consumption meter which in turn connects to the wiring in the customer's premises (e.g., home power wiring).

While the pole transformer and the power consumption meter cause comparatively little power loss at the low frequency at which the power is supplied, both the transformer and the meter can cause substantial radio frequency, communication signal power loss. Therefore, a parallel communication signal electrical path around at least the pole transformer has been provided to improve the communication signal power in the premises wiring. However, the prior art proposals for the parallel path have involved conductive (galvanic) connections both at the input and output of the pole transformer which requires skilled installers and in at least some cases, interruption of the power during installation of parallel path, by-pass equipment.

In today's world, a substantial number of household devices operate using some form of electricity. In one case, household devices operate using a battery power source that is integrated within the devices. These include laptop computers, stereo systems, electric shaving razors, etc. Typically, battery life of such devices is very limited, which prevents prolonged usage of the device and in some cases, such as laptop computers, causes possible loss of data, when batter runs out of power. Yet, other household devices cannot operate without being connected to a power outlet. Such device include kitchen devices (e.g., refrigerators, electric ranges, dishwashers, etc.), communications equipment (e.g., telephones, modems, routers, servers, etc.), multimedia devices (e.g., printers, facsimiles, televisions, DVD-players, VHS-players, desktop computers, etc.), and other devices that require sufficient continuous source of power to properly operate. Such devices are typically connected to a 110 Volt electrical outlet (or a 220 Volt outlet or other type voltage outlet depending on the country). Such electrical outlets are connected (e.g., hard-wired) to a number of electrical lines that are in turn hard-wired to electrical junction boxes in the house (or a building). The junction boxes are in turn connected to electrical micro-grids, which are part of larger grids connected to power stations that generate electricity, as illustrated in FIG. 1.

Typically, a household contains a specific number of electrical power outlets into which household devices can be plugged in. Such electrical power outlets as well as the junction box allow only a certain number of devices connected to the electrical system in the house, i.e., the electrical lines in the household are designed to accept a specific load. Each electrical line has a specific load limit that is determined by the amount of current that the line can supply. Exceeding electrical line's limit (i.e., connecting too many devices to the line) causes overload and a power outage on that particular electrical line. Thus, if too many devices are connected to the line, it may overload.

Further, a limited number of electrical outlets in the household prevents electrical connection of a group of devices located in one spot. For example, each of the following devices: a laptop computer, a printer located next to the computer, a modem, a router, a server, a laptop speaker system, and other multi-media devices, may require a separate electrical outlet. A power strip device that plugs into the electrical outlet may accommodate electrical needs of all of these devices by providing multiple sockets on a single power strip plate. The power strip then connects to the available electrical outlet with a single plug. However, the power strip device adds to the clutter with the wires coming from the connecting devices, consumes an electrical outlet and prevents other devices from connecting to the power outlet. The power strip device may also immobilize mobile units having wireless communication capabilities.

Currently available electrical outlet adaptors include vapor dispensing devices. The vapor dispensing adaptor attaches to an electrical outlet and dispenses aroma vapors. In some cases, the vapor dispensing adaptor devices are plugged into the outlet, thereby consuming one or all available electrical sockets. In other cases, the vapor dispensing adaptors are plugged into the outlet but retain the availability of the sockets. However, they do not provide for connection to multimedia, networking, and communication devices.

Additionally, some conventional outlet adaptor devices that can be plugged into an existing outlet are extremely bulky. When plugged in, these adaptor devices substantially protrude away from the wall, consume a lot of space, create an obstacle when placing objects in their vicinity, and do not preserve outlet space.

Thus, there is a need for a power outlet adaptor device that is capable of preserving electrical outlet availability for connection of devices, providing multimedia, networking, and other communication capabilities to devices, and retaining an aesthetic appeal of an electrical outlet. There is also a need for an outlet adaptor device that has multimedia, networking, and communication capabilities as well as resembles a standard electrical wall outlet without substantially protruding away from the wall, and thus, retaining its aesthetic appeal.

SUMMARY OF THE INVENTION

The present invention relates to power line communications. In particular, the present invention relates to adaptor devices configured to be connected to electrical wall outlets. The adaptor devices include multimedia, networking, and communication capability, as well as, preserve electrical outlet availability for connection of various devices.

In an embodiment, the adaptor device includes a housing and at least one multimedia, networking and/or communications component configured to be secured within the housing. The component provides multimedia, networking and/or communications capabilities. The device also includes an electrical socket box that includes at least one electrical socket that accommodates an electrical device plug. The housing is configured to fit around the electrical socket box. The electrical socket box is further configured to be electrically coupled to the at least one multimedia, networking, and/or communications component.

In an alternate embodiment, the adaptor device is configured to be electrically wired to an existing electrical line and further configured to replace an existing wall outlet.

In another alternate embodiment, the adaptor device includes at least one plug configured to be electrically coupled to the electrical socket box. The plug is configured to be inserted into an electrical outlet and is further configured to provide power to the multimedia, networking and/or communications component.

In yet another alternate embodiment, the present invention relates to a method of making the adaptor device. The method includes providing a housing and securing at least one multimedia, networking and/or communications component within the housing. The multimedia, networking and/or communications component configured to provide multimedia, networking and/or communications capabilities. The method further includes providing an electrical socket box that includes at least one electrical socket configured to accommodate an electrical device plug. The housing is configured to fit around the electrical socket box. The method also includes electrically coupling the electrical socket box to the multimedia, networking, and/or communications component.

Further features and advantages of the invention, as well as structure and operation of various embodiments of the invention, are disclosed in detail below with references to the accompanying drawings.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Figure 1:
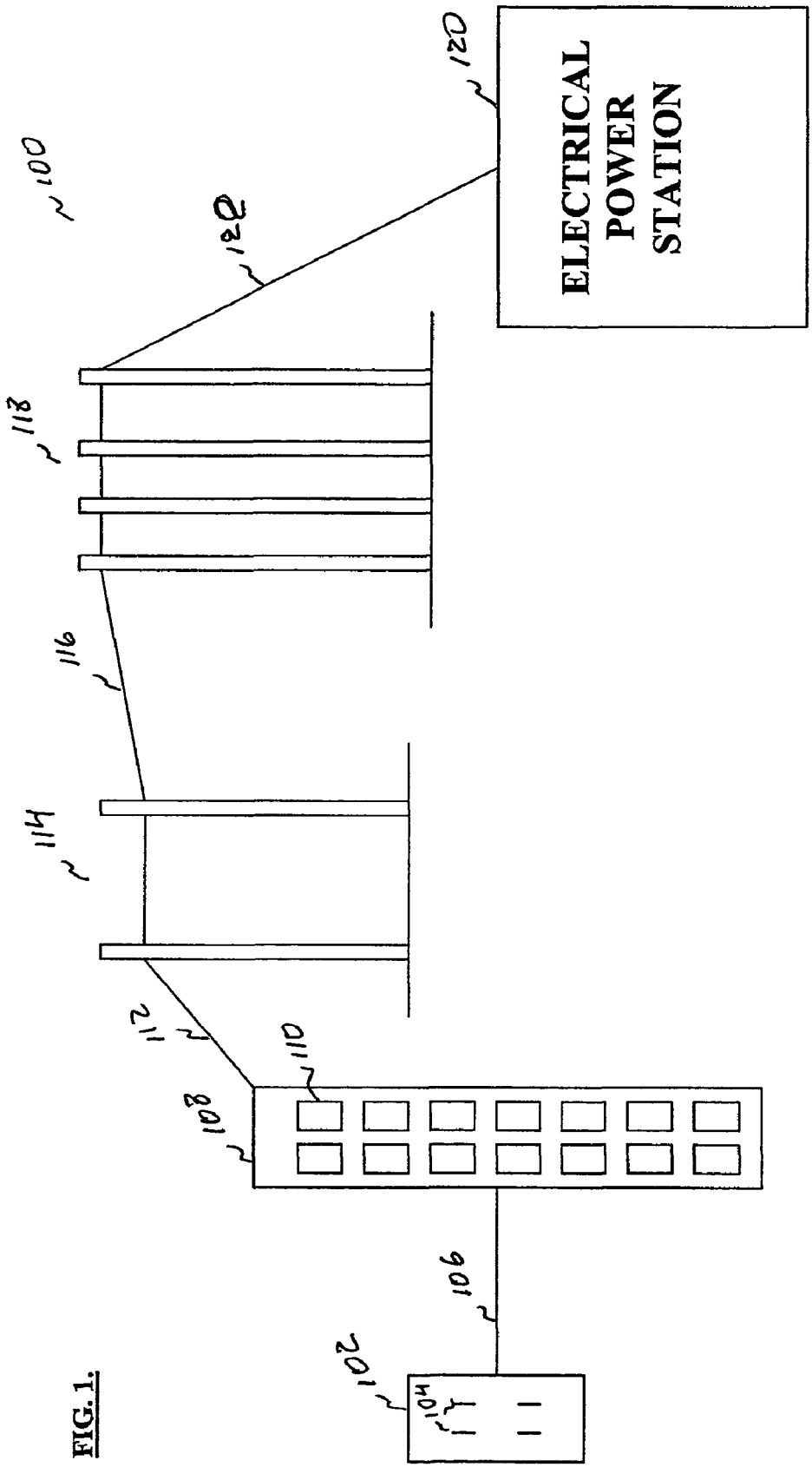
FIG. 1 illustrates a conventional electrical system.

FIG. 1 illustrates a conventional electrical system 100. System 100 includes an electrical power outlet 102, house electrical line 106, house junction box 108, electrical micro-grid 114, electrical grid 118, electrical power station 120, and power lines 112, 116, and 122. The electrical power outlet 102 includes a plurality of sockets 104 to which various electrical devices (not shown in FIG. 1) can be attached. The electrical power outlet 102 is coupled to the junction box 108 via the house electrical line 106. The junction box 108 includes a plurality of switches 110. The switches 110 connect external electrical power line 112 to the house electrical lines 106. Each switch can supply electrical power to a specific electrical line 106 within the house. The electrical line 106 can service a plurality of electrical outlets 102, electrical power switches (not shown in FIG. 1), or other devices requiring electric power to operate.

The electrical micro-grid 114 connects the house electrical junction box 108 to the grid 118 via electrical power lines 112 and 116. The micro-grid 114 can include electrical sub-station that provides switching of electrical current supplied by the electrical power station 120 through the grids 118. A plurality of micro-grids 114 can be connected to a plurality of grids 118. Further, each micro-grid 114 can service a plurality of households or buildings containing electrical junction boxes 108.

The grids 118 are coupled to the electrical power station 120 via power lines 122. The power lines 122 can be any conventionally known high-voltage power lines. As can be understood by one skilled in the art, the above description of the system 100 is presented for illustrative purposes only and is not intended to limit the scope of the present invention. Further, some components of the electrical system 100 may have been omitted for ease of illustration.

Figure 2:
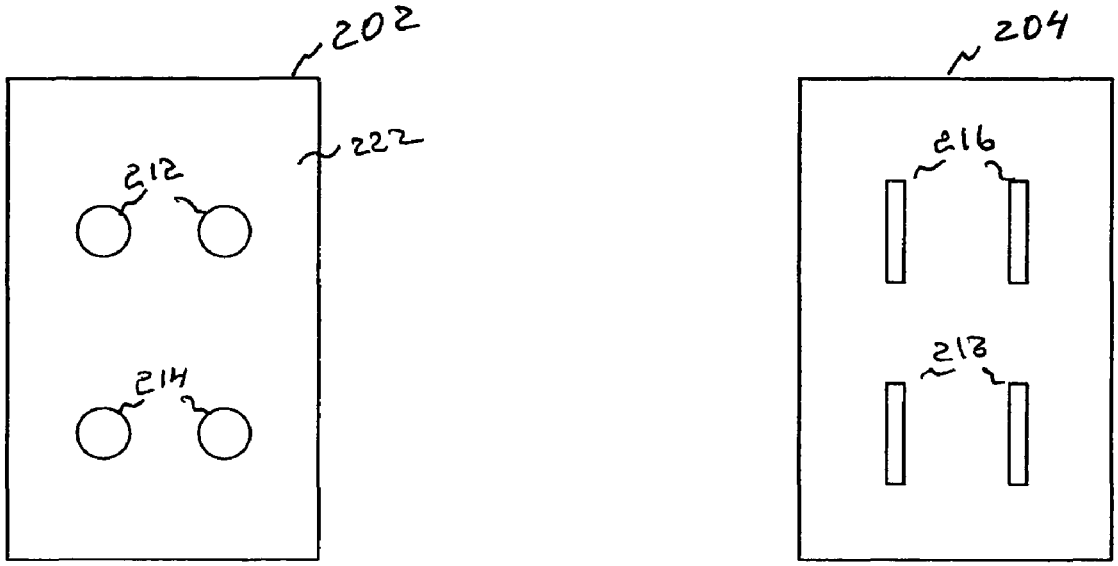
FIG. 2 illustrates conventional power outlets.

FIG. 2 illustrates conventional electrical power outlets 202 and 204. Electrical power outlet 202 is an outlet designed to supply electricity to devices operating under voltage of 220 Volts. Such outlets are typically used in European countries, where voltage is 220V. The outlet 202 includes two sockets 212 and 214 and a cover 222. The sockets 212 and 214 are designed to accommodate a two prong plug having rounded prongs (not shown in FIG. 2). The cover 222 is configured to allow the sockets 212 and 214 to show through the cover 222. The cover 222 is typically plastic, although other materials can be used. Electrical power outlet 204 is an outlet designed to supply electricity to devices operating under voltage of 110 Volts. Such outlets are typically used in North American countries, where operating voltage is 110V. The outlet 204 includes two sockets 216 and 218 and a cover 224. The sockets 216 and 218 are designed to accommodate a two prong plug having flat prongs (not shown in FIG. 2). The cover 224 is configured to allow the sockets 212 and 214 to show through the cover 224. Similarly to the cover 222, the cover 224 is typically plastic, although other materials can be used.

The power outlets 202 and 204 are typically mounted on a wall in a room of a house (or a building). The outlets 202 and 204 are coupled to the electrical line 106 (not shown in FIG. 2) by hard-wiring the outlets 202, 204's electrical contacts to the electrical line 106 wires. Such wiring is typically done in accordance with specific electrical safety guidelines and regulations, so as to prevent a possibility of malfunction or fire. It is typical that rooms within houses are pre-wired with electrical lines 106 and appropriate wall openings are made for installation of electrical outlets 202 or 204. The electrical lines 106 are exposed through such wall openings so that the electrical power outlets 202 or 204 can be hard-wired to the electrical line 106. Once the wiring of the power outlets 202 or 204 to the electrical line 106 is completed, the respective covers 222 and 224 are attached to the wall to close the openings made in the wall for mounting electrical power outlets 202 and 204.

The embodiments of FIG. 2 illustrate power outlets 202 and 204 having two sets of sockets. As can be understood by one skilled in the art, a single or a multiple socket power outlet can be used instead of a two-socket outlet. Multiple socket power outlets can accommodate a number of devices requiring electricity for their operation.

Figure 3:
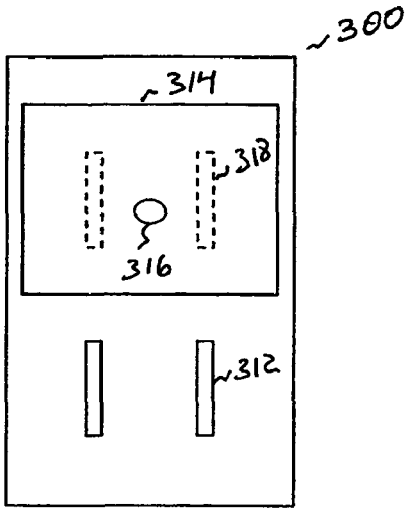
FIG. 3 illustrates top and side views of a conventional electrical outlet having a plug attached to one of its sockets.
Figure 3:
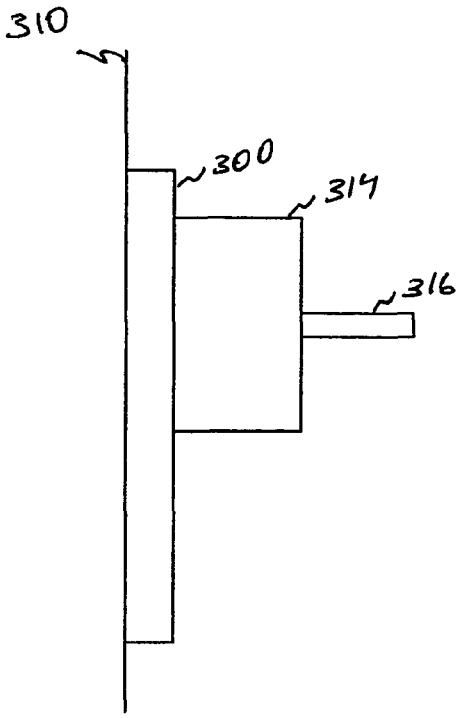

FIG. 3 illustrates a front view and a side view of an electrical power outlet having an electrical plug plugged into one of its sockets. An electrical outlet 300 placed on the wall 310 includes two sockets 312 and 318. A plug 314, connected (using wire 316) to an electrical device (not shown in FIG. 3), occupies socket 318. The only socket that remains available is socket 312. As such, only one additional device can be plugged into the outlet 300.

Figure 4A:
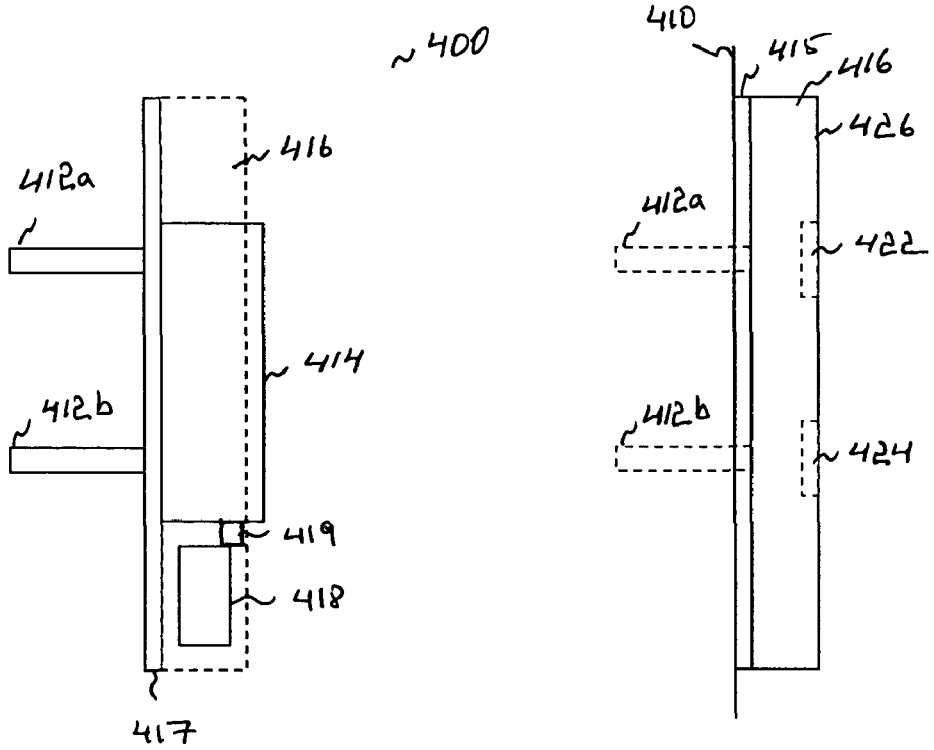
FIG. 4A illustrates exemplary side views of an embodiment of an adaptor device, according to the present invention.
Figure 4B:
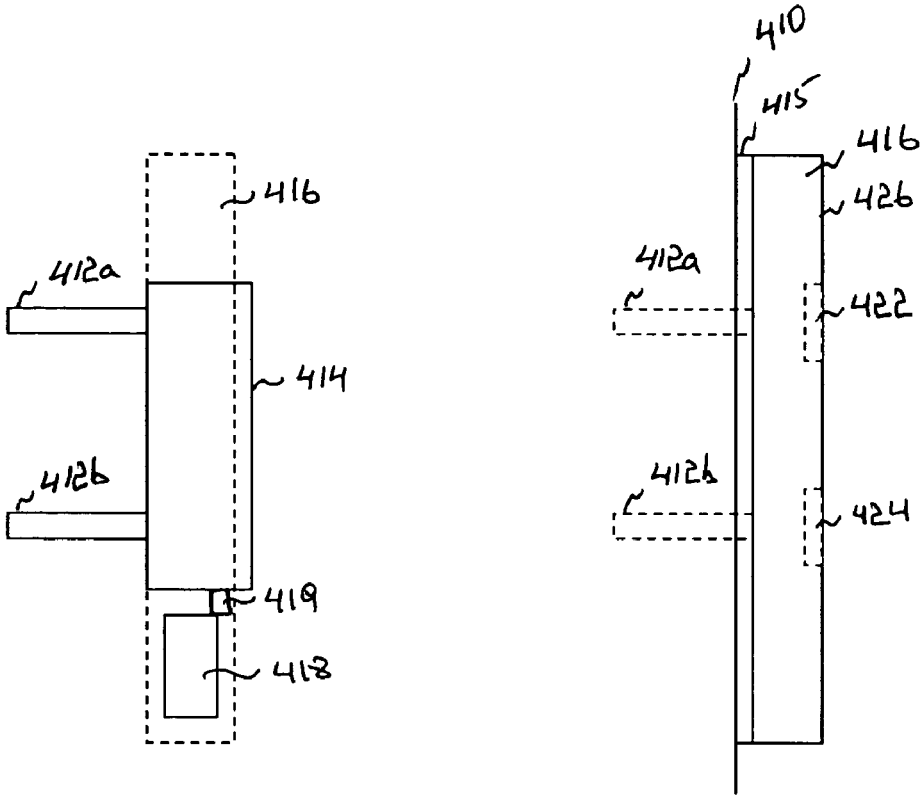
FIG. 4B illustrates exemplary side views of another embodiment of an adaptor device, according to the present invention.
Figure 4C:
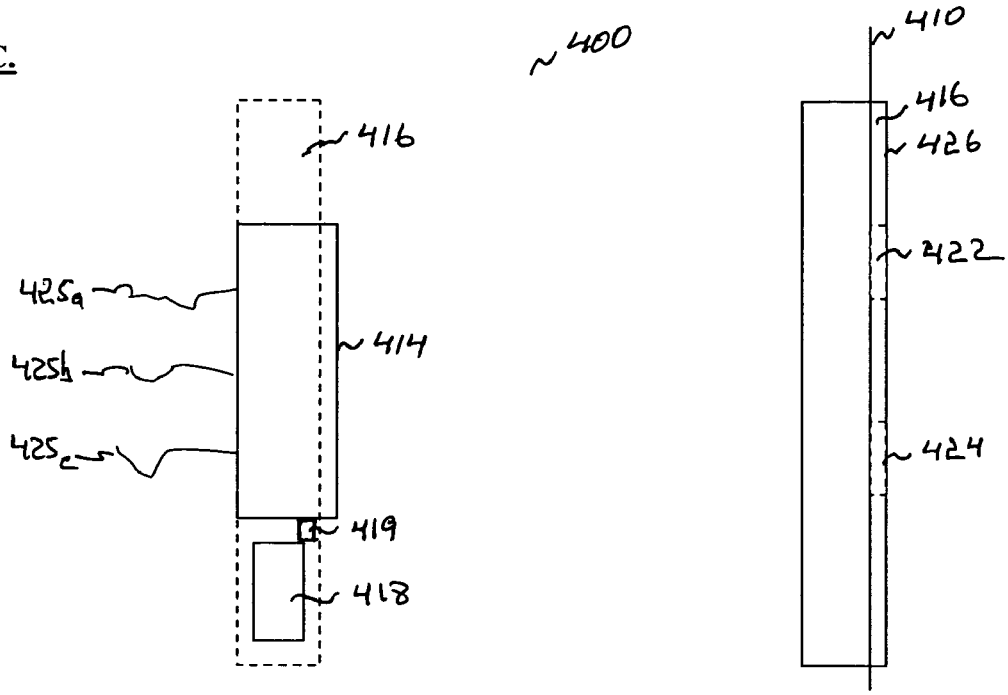
FIG. 4C illustrates exemplary side views of yet another embodiment of an adaptor device, according to the present invention.

FIGS. 4A-4C illustrate various embodiments of an adaptor device 400, according to the present invention. FIGS. 4A and 4B illustrate embodiments of the adaptor device 400 that is configured to be plugged into an existing electrical outlet, according to the present invention. FIG. 4C illustrates an embodiment of the adaptor device 400 that is configured to be wired to an existing electrical line and replace an existing electrical outlet, according to the present invention. The following is a more detailed discussion of each of the embodiments shown in FIGS. 4A-4C.

FIG. 4A illustrates side views of an adaptor device 400 that is configured to be plugged into an electrical outlet 415, which is attached to a wall 410, according to the present invention. The illustrated adaptor device 400 accommodates a two-socket outlet. As can be understood by one skilled in the art, the adaptor device 400 can accommodate outlets having any number of sockets.

The adaptor device 400 includes a pair of plugs 412*a* and 412*b*, a base 417, a cover plate or a housing 416 having a face 426, electrical socket box 414, a multimedia/networking/communications component 418, and a pair of sockets 422, 424. In this embodiment, the plugs 412 and the electrical socket box 414 are configured to be coupled to the base 417 and the housing 416 is configured to fit around the electrical socket box 414 and attach to the base 417. The component 418 is configured to be secured within the housing 416.

The plugs 412 are configured to fit into the electrical outlet sockets (not shown in FIG. 4). The plugs 412, as shown, are accommodated by a 110 V outlet. As can be understood by one skilled in the art, the plugs 412 can be configured to fit into a 220 V outlet or any other type of outlet. Additionally, the plugs 412 can include a ground connection (i.e., a three-prong plug) that can be accommodated by electrical outlets having a ground connection. As can be understood by one skilled in the art, the plugs 412 can be configured to fit into electrical outlets having any number of sockets (e.g., plugs 412 can be four-prong plugs, five-prong plugs, etc., which are sometimes required for electrical devices with higher electricity consumption parameters).

The base 417 electrically couples the plugs 412*a*, 412*b* and sockets 422, 424 placed on the face 426 of the housing 416. The sockets 422, 424 can be configured to be disposed on the face 426 of the housing 416 in such a way as to resemble a regular wall outlet (as the one illustrated in FIG. 2). This way, the aesthetic appeal of the regular wall outlet is preserved without cluttering electrical wall outlet 415 with bulky attachments.

In addition to providing wiring from the plugs 412*a*, 412*b* to sockets 422, 424, the electrical socket box 414 provides wiring for the multimedia, networking, and/or communications component 418. In an embodiment, the electrical socket box 414 is configured to be electrically coupled to the component 418. The component 418 can be a printed circuit board that contains data and multimedia networking circuitry. The component 418 can also provide networking capabilities, such as wireless capabilities to various devices placed in the household. For example, the component 418 can serve as a wireless modem for computers located in various rooms in a household. The component 418 can also provide multimedia capabilities. For example, component 418 can provide various text, audio, graphics, animation, video, and/or other capabilities either by itself or along with devices that are configured to communicate with it. The component 418 draws power from the electrical line coupled to the electrical outlet 415 through the electrical socket box 414. As can be understood by one of ordinary skill in the art, the capabilities of the component 418 are not limited to those listed above.

In an embodiment, component 418 is electrically coupled to the plug 412*a* and, thus, the plug 412*a* provides electrical power to the component 418. In an alternate embodiment, component 418 is electrically coupled to the plug 412*b* and, thus, the plug 412*b* provides electrical power to the component 418. In another alternate embodiment, component 418 is electrically coupled to the plugs 412*a* and 412*b*, hence, both plugs provide power to the component 418. In yet another alternate embodiment, one or both plugs 412 are electrically coupled to the electrical socket box 414, which is in turn electrically coupled to the component 418. As can be understood by one skilled in the art, other ways of providing power to the component 418 are possible.

In an embodiment, the housing 416 includes a light-emitting structure 419. The light-emitting structure 419 is electrically coupled to the component 418. The light-emitting structure 419 may emit variable intensity and/or color (e.g., red, yellow, and greed) light based on parameters associated with networking traffic processed by the component 418, status of the component 418, as well as, nature and content of the multimedia that is handled by the component 418. The component 418 can also indicate status of the multimedia and/or communications data that is being handled by the component 418. As can be understood by one skilled in the art, the light produced by the light-emitting structure 419 can indicate other status of the component 418 or the entire adaptor device 400.

In an alternate embodiment, the adaptor device 400 may include additional multimedia, networking, and/or communications interfaces (not shown in FIG. 4, but are shown in FIG. 5) that can provide power and other types of connectivity to various device coupled to such multimedia, networking, and/or communications interfaces. The component 418 can be coupled to such additional interfaces and provide various types of connectivity to devices coupled to the additional interfaces. Alternatively, the component 418 is not coupled to the additional interfaces but provides connectivity to devices specifically coupled to the component 418. As can be understood by one skilled in the art, the component 418 and/or additional multimedia, networking, and/or communications interfaces can provide wireless, wired, or wireline connections to various devices.

The adaptor device 400, when plugged into the outlet 415, slightly protrudes away from the wall 410. Thus, the adaptor device 400, when plugged into the electrical outlet 415, appears to have sufficiently minimal thickness so that it fits the above referenced component 418, any additional multimedia, networking and/or communications interfaces, and electrical wiring for the sockets 422 and 424. As such, the adaptor device 400, when plugged in, is capable of maintaining aesthetic appeal of the wall and the electrical outlet 415. In an embodiment, the adaptor device 400 is sized to be of substantially the same height and width as the electrical outlet 415. Such sizing further preserves aesthetic appeal of the adaptor device 400. Because of adaptor device's minimal thickness and substantially the same equal length and width, the adaptor device 400 resembles the original electrical wall outlet 415.

In an embodiment, the adaptor device's housing 416 can be removable. Thus, a user can exchange the housing 416 with another housing 416, but still maintain all electrical connections attached to the electrical wall outlet 415. The housing 416 can be attached to the adaptor device 400 by screws, bolts, Velcro®, clips, clamps, adhesives, snap-ons, or any other means. The housing 416 can be of different colors, configured to be painted by the user, or translucent.

As can be understood by one skilled in the art, the adaptor device 400 can include a single plug 412 and being able to be plugged into either a single socket or a multiple socket electrical wall outlet 415 and provide at least one socket 422 in its electrical socket box 414. For example, the adaptor device 400, having a single plug 412, can include two or more sockets 422 in its electrical socket box 414. This allows plugging more than one device into the adaptor device 400.

In the embodiment shown in FIG. 4B, the adaptor device 400 includes all of the above listed elements, except the base 417. In this embodiment, the plugs 412 are configured to be electrically coupled to the electrical socket box 414. The component 418 is also configured to the be electrically coupled to the electrical socket box 414. As in FIG. 4A embodiment, the socket box 414 includes the sockets 422 and 424 that accommodate electrical device plugs. As can be understood by one skilled in the art, the socket box 414 can include at least one electrical socket 422 (or 424).

Similarly to FIG. 4A embodiment, the electrical socket box 414 is configured to provide electrical coupling to the component 418, the light emitting structure 419, the plugs 412, and the sockets 422 and 424. As in FIG. 4A, the component 418 and the structure 419 are configured to be secured within the housing 416. The housing 416 is configured to fit around the electrical socket box 414. In an embodiment, the housing 416 contacts the existing wall outlet 415 once the adaptor device 400 is plugged into the outlet 415. The housing 416 can be attached to the outlet 415 by means of screws, bolts, Velcro®, clips, clamps, adhesives, snap-ons, or other means. Embodiments shown in FIGS. 4A and 4B are configured to maintain the outlet space in the house and retain the aesthetic appeal of standard electrical outlets.

In an embodiment shown in FIG. 4C, the adaptor device 400 does not include the base 417 or the plugs 412. Instead, the adaptor device 400 is configured to be wired to the existing electrical line (not shown in FIG. 4C) in a household or a building. The adaptor device 400 includes electrical socket box 414 having sockets 422 and 424, housing 416, multimedia, networking, and/or communications component 418, light emitting structure 419, and electrical wires 425(*a,b,c*).

Figure 6:
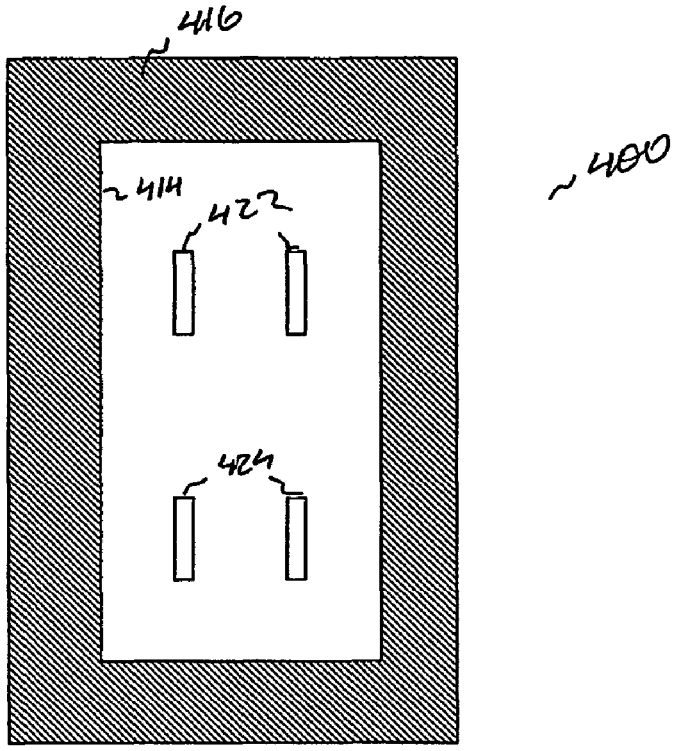
FIG. 6 illustrates an exemplary top view of the adaptor device of FIGS. 4A, 4B, and 4C, according to the present invention.

The wires 425 are electrically coupled to the electrical socket box 414 and are further configured to electrically couple the adaptor device 400 to the household's electrical line. Once the wires 425 are coupled to the electrical line, the adaptor device 400 is inserted into an opening created for a wall outlet. As can be understood by one of ordinary skill in the art, the adaptor device can be configured to fit into an opening sized for a standard electrical wall outlet or any other type of opening (not shown in FIG. 4C). Once inserted into the opening, the adaptor device 400 appears as a standard electrical wall outlet (as shown in FIGS. 4C and 6). As in FIGS. 4A and 4B embodiments, the housing 416 can fit around the electrical socket box 414. Also, the housing 416 can be configured to attach to the wall (on the interior and/or exterior sides of the wall). The housing 416 can be coupled to the wall using screws, bolts, Velcro®, clips, clamps, adhesives, snap-ons or any other means. This embodiment of the adaptor device 400 eliminates the use of plugs 412 (shown in FIGS. 4A and 4B), replaces existing electrical wall outlets, preserves outlet space in the house, and maintains aesthetic appeal of wall outlets.

Figure 5A:
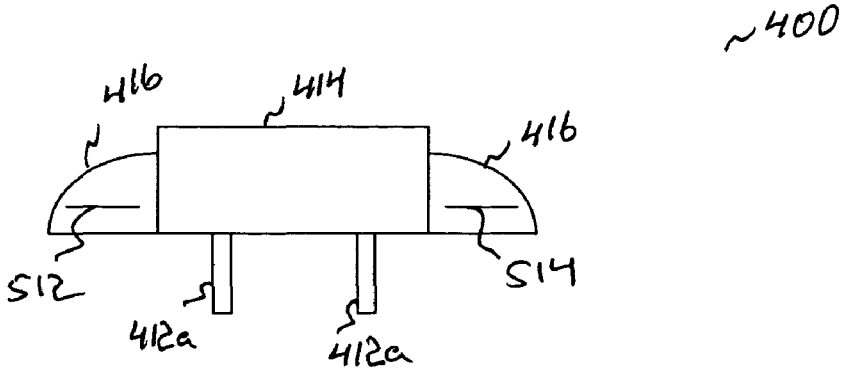
FIG. 5A illustrates an exemplary cross-section view of the adaptor device of FIGS. 4A and 4B, according to the present invention.

FIG. 5A illustrates a cross-sectional view of the adaptor device 400 shown in FIGS. 4A and 4B. As shown, the adaptor device 400 includes the electrical socket box 414 that contains sockets 422 and 424 (not shown in FIG. 5A, but illustrated in FIGS. 4A and 4B) and the housing 416 that surrounds the socket box 414. As illustrated in FIG. 5A, the housing 416 has rounded edges. As can be understood by one having skill in the art, the edges of the housing 416 can be square, round, oval, triangular, or any other desired shape.

Multimedia/networking/communications components 512 and 514 are disposed within the housing 416. The components 512 and 514 are similar to the component 418 and additional multimedia/networking/communications devices discussed with respect to FIGS. 4A and 4B. As shown in FIG. 5A, the components 512 and 514 are disposed on each side of the electrical socket box 414. As can be understood by one skilled in the art, the multimedia, networking, and/or communications components can be disposed in any location of the adaptor device 400.

Figure 5B:
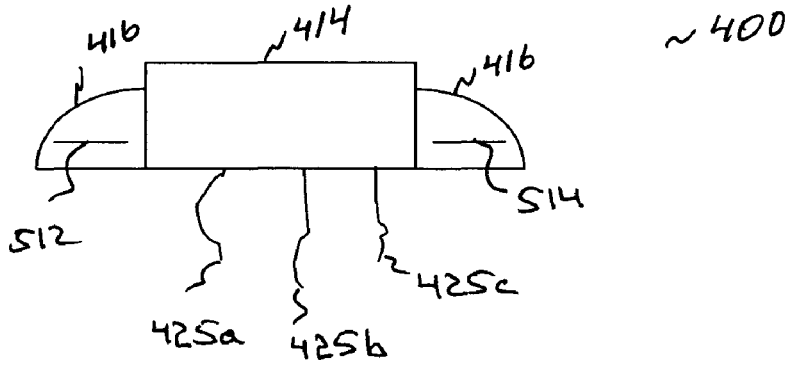
FIG. 5B illustrates an exemplary cross-section view of the adaptor device of FIG. 4C, according to the present invention.

FIG. 5B illustrates a cross-sectional view of the adaptor device 400 shown in FIG. 4C. The shown adaptor device 400 does not include plugs 412, but instead includes wires 425 for electrically wiring the adaptor device 400 to an existing electrical line.

FIG. 6 illustrates a front view of the adaptor device 400, as shown in either FIG. 4A, 4B, or 4C, that includes the housing 416 (the face 426 of the housing 416 is shown shaded) that fits around (or surrounds) the electrical socket box 414 that includes a pair of sockets 422 and 424. In an embodiment, the housing 416 is configured to friction fit around the electrical socket box 414. As shown in FIG. 6, the adaptor device 400 on the outside appears as a regular electrical wall outlet that is can be used for plugging in various devices.

Example embodiments of the methods and components of the present invention have been described herein. As noted elsewhere, these example embodiments have been described for illustrative purposes only, and are not limiting. Other embodiments are possible and are covered by the invention. Such embodiments will be apparent to persons skilled in the relevant art(s) based on the teachings contained herein. Thus, the breadth and scope of the present invention should not be limited by any of the above-described exemplary embodiments, but should be defined only in accordance with the following claims and their equivalents.

What is claimed:

1. A power outlet adaptor device, comprising a housing;

at least one power plug configured to be electrically coupled to a power source via an electrical socket box;

at least one of a power socket that is configured to pass the power source's electricity from said power plug to at least one of a receptacle;

at least one of a multimedia, networking and/or communications component, wherein the component is configured to be secured within said housing, configured to be powered by the power source and further configured to provide communications functions for devices configured to communicate with it, and wherein the multimedia networking and/or communications component provides at least a broadband powerline communications function to the source and load sides of the adaptor device.

2. The adaptor device according to claim 1, wherein said adaptor device is configured to be electrically wired to an existing electrical line and further configured to replace an existing wall outlet.

3. The adaptor device according to claim 1, where the housing is configured to fit around said electrical socket box.

4. The adaptor device according to claim 3, wherein said at least one plug is configured to be inserted into an electrical socket and is further configured to provide power to said at least one multimedia, networking and/or communications component.

5. The adaptor device according to claim 1, wherein said housing is removable.

6. The adaptor device according to claim 1, wherein said at least one multimedia, networking and/or communications component provides connection selected from a group consisting of: wireless connection, wired connection, or wireline connection.

7. The adaptor device according to claim 1, further comprising a light-emitting device configured to emit variable intensity and color light.

8. The adaptor device according to claim 7, wherein said light-emitting device is configured to indicate status of said at least one multimedia, networking and/or communications component;

wherein said status is indicated by said variable intensity and color light.

9. The adaptor device according to claim 8, wherein said light-emitting device is further configured to indicate status of a network provided by said at least one multimedia, networking and/or communications component;

wherein said status of the network is indicated by said variable intensity and color light.

10. The adaptor device according to claim 1, further comprising at least two sockets configured to be disposed on said electrical socket box.

11. The adaptor device according to claim 1, further comprising two plugs configured to be coupled to said electrical socket box.

12. The adaptor device according to claim 11, wherein said two plugs are configured to be inserted into a two-socket electrical wall outlet.

13. The adaptor device according to claim 12, further comprising a top plug configured to be inserted into the electrical wall outlet; and a bottom plug configured to be inserted into the electrical wall outlet.

14. The adaptor device according to claim 13, wherein said top plug provides power to said at least one multimedia, networking and/or communications component.

15. The adaptor device according to claim 13, wherein said bottom plug provides power to said at least one multimedia, networking, and/or communications component.

16. The adaptor device according to claim 13, wherein said top and said bottom plugs provide power to said at least one multimedia, networking and/or communications component.

17. The adaptor device according to claim 1, wherein said electrical socket box is configured to be plugged in to an existing wall socket using at least one plug electrically coupled to said electrical socket box said housing is further configured to be coupled to one of said electrical socket box or an existing wall outlet.

18. The adaptor device according to claim 1, wherein said housing is translucent.

19. The adaptor device according to claim 1, wherein said housing is provided in a selection of colors.

20. The adaptor device according to claim 1, wherein the adaptor device is configured to resemble the electrical wall socket into which the adaptor device is plugged in using at least one plug.

21. The adaptor device according to claim 1, wherein the adaptor device has a substantially the same height and width as the electrical wall outlet.

22. The adaptor device according to claim 1, wherein a combination of said housing has a substantially minimal thickness and is configured to minimally protrude away from a wall.

23. A method of making a power outlet adaptor device, comprising the steps of:

providing a housing;

coupling at least one power plug to a power source by way of an electrical box, and configuring at least one of the power sockets to receive electrical power from the power source plug, securing at least one multimedia, networking and/or communications component within said housing, wherein said at least one multimedia, networking and/or communications component is configured to provide multimedia, networking and/or communications capabilities; and where at least one of those capabilities is broadband powerline communications configured to communicate with multimedia devices that are on the power source and power load sides of the adaptor device, and electrically coupling said electrical box to said at least one multimedia, networking, and/or communications component.

24. The adaptor device in claim 1 where the multimedia, networking and/or communications component provides audio, text, graphics, animation services to devices communicating with it.

* * * * *